US009890998B2

(12) United States Patent
Jiao et al.

(10) Patent No.: US 9,890,998 B2
(45) Date of Patent: Feb. 13, 2018

(54) SUBSTRATE HEATING APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Yu Jiao, Beijing (CN); Yanming Wang, Beijing (CN); Qingyang Yao, Beijing (CN); Jie Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 654 days.

(21) Appl. No.: 14/366,573

(22) PCT Filed: Jun. 26, 2013

(86) PCT No.: PCT/CN2013/077954
§ 371 (c)(1),
(2) Date: Jun. 18, 2014

(87) PCT Pub. No.: WO2014/172988
PCT Pub. Date: Oct. 30, 2014

(65) Prior Publication Data

US 2015/0211792 A1 Jul. 30, 2015

(30) Foreign Application Priority Data

Apr. 23, 2013 (CN) ..... 2013 1 0144082

(51) Int. Cl.
*F26B 21/02* (2006.01)
*F26B 21/12* (2006.01)
(Continued)

(52) U.S. Cl.
CPC ..... *F26B 21/02* (2013.01); *F26B 21/00* (2013.01); *F26B 21/12* (2013.01); *F26B 21/14* (2013.01); *F26B 23/04* (2013.01); *F26B 25/06* (2013.01)

(58) Field of Classification Search
CPC ..... F26B 21/02; F26B 21/14; F26B 25/06; F26B 23/04; F26B 21/12; F26B 21/00
See application file for complete search history.

(56) References Cited

U.S. PATENT DOCUMENTS 5,180,000 A * 1/1993 Wagner ..... C23C 14/50 118/725
6,043,923 A * 3/2000 Lee ..... G01N 21/15 324/756.01

(Continued)

FOREIGN PATENT DOCUMENTS

CN 101101856 A 1/2008
CN 102085511 A 6/2011

(Continued)

OTHER PUBLICATIONS

International Preliminary Report on Patentability dated Oct. 27, 2015 PCT/CN2013/077954.

(Continued)

*Primary Examiner* — Jessica Yuen
(74) *Attorney, Agent, or Firm* — Ladas & Parry LLP

(57) ABSTRACT

A substrate heating apparatus includes: a heating chamber, as well as a heating unit and a suspension holding unit which are provided in the heating chamber. The heating unit is provided at the bottom of the heating chamber, and the suspension holding unit holds the substrate in suspension above the heating unit. The apparatus avoids collision and friction on the substrate, and ensures uniform heating of the substrate.

15 Claims, 5 Drawing Sheets

(51) Int. Cl.

| | |
|---|---|
| ***F26B 21/14*** | (2006.01) |
| ***F26B 23/04*** | (2006.01) |
| ***F26B 25/06*** | (2006.01) |
| ***F26B 21/00*** | (2006.01) |

(56) References Cited

U.S. PATENT DOCUMENTS

| | | | | |
|---|---|---|---|---|
| 6,644,964 | B2 * | 11/2003 | Shirakawa | H01L 21/67109 118/728 |
| 2012/0088350 | A1 * | 4/2012 | Kerdiles | H01L 21/187 438/455 |
| 2012/0124857 | A1 | 5/2012 | He et al. | |

FOREIGN PATENT DOCUMENTS

| | | | |
|---|---|---|---|
| CN | 202070474 | U | 12/2011 |
| WO | 20121148500 | A1 | 8/2012 |

OTHER PUBLICATIONS

First Chinese Office Action Appln. No. 201310144082.2; Dated Nov. 3, 2014.
International Search Report Appln. No. PCT/CN2013/077954; Dated Feb. 13, 2014.

* cited by examiner

SUBSTRATE HEATING APPARATUS

FIELD

The present disclosure relates to a substrate heating apparatus.

BACKGROUND

A manufacturing procedure of a display panel comprises mainly three processing stages: array processing, cell processing and module processing, in which, the array processing is primarily responsible for providing an array substrate for the cell processing.

In particular, the array processing comprises a continuous cycle of four processes performed on a glass substrate, i.e., film forming, masking, exposing and etching, and ultimately a desired pattern of thin-film-transistor (TFT) array is fabricated on the glass substrate, thereby forming an array substrate. In the masking process, the glass substrate after being coated with a photosensitive material needs to be heated, for allowing the photosensitive material coated on the glass substrate to be partially-cured, so as to ensure the quality of exposure with ultraviolet light on the photosensitive material during subsequent exposing process. FIG. 1 shows a conventional heating apparatus for heating a glass substrate. The heating apparatus comprises: a heating chamber 1' for receiving a glass substrate, and a heating unit 3' provided at the bottom of the heating chamber 1'; and a plurality of supporting pins 4' on the heating unit 3' for supporting the glass substrate. FIG. 2 is an enlarged view of a supporting pin 4'. The glass substrate faces the heating unit 3'. Here, it should be noted that in order to see clearly the supporting pins 4' inside the heating chamber 1', the top (i.e., the cover 2') of the heating chamber shown in FIG. 1 is in an opened state. In addition, the cover 2' can be opened to facilitate maintenance of the device inside the heating chamber 1', but in normal state (including a state of heating a glass substrate) the cover 2' is in a closed state, so that the heating chamber 1' forms an airtight space. The structure of such heating chamber is also applicable to the present disclosure.

The heating operation of the heating apparatus is as following. Firstly, a glass substrate is put into the heating chamber 1' in such a way that the glass substrate faces the heating unit 3' and is supported on the plurality of supporting pins 4', and then the glass substrate is heated by the heating unit 3'. Such heating operation requires physical contact between the glass substrate and the supporting pins, and this will cause not only hard collision and friction on the substrate and thus result in damages to the substrate, but also a temperature difference between portions of the substrate in contact with the supporting pins 4' and other portions, of the substrate so that the glass substrate is non-uniformly heated.

SUMMARY

Embodiments of the present disclosure provide a substrate heating apparatus, which can avoid collision and friction on the substrate, and ensure uniform heating of the substrate.

According to the present disclosure, there is provided a substrate heating apparatus, which comprises: a heating unit, and a suspension holding unit located on the heating unit and hold the substrate above the heating unit in suspension.

In an example, the suspension holding unit comprises: a gas-flow supporting unit for blowing a gas toward the substrate so that the substrate is held above the heating unit in suspension.

In an example, the gas-flow supporting unit comprises: a gas source, a gas blower connected with the gas source, and a gas feeding channel connected with the gas blower, the gas feeding channel is provided in the heating unit, and the gas blower blows a gas flow through the gas feeding channel, and the gas flow blew from the gas feeding channel has a flowing direction toward the substrate.

In an example, the gas feeding channel comprises a first gas feeding channel and a second gas feeding channel interconnected to each other with their axes perpendicular to each other; the first gas feeding channel is connected with the gas blower, and the axis of the second gas feeding channel is oriented perpendicular to the surface of the substrate.

In an example, the gas-flow supporting unit further comprises: a gas heater provided between the gas source and the gas blower, the gas heater has a first side connected with the gas source and a second side connected with the gas blower.

In an example, the gas-flow supporting unit further comprises: a gas retrieving unit connected with the gas source and retrieving a gas flow flowing out of the gas feeding channel.

In an example, the gas retrieving unit comprises: a pump connected with the gas source, and a gas retrieving channel connected with the pump; the gas retrieving channel is provided in the heating unit, and the pump draws a gas flow through the gas retrieving channel toward the heating unit.

In an example, the gas retrieving channel comprises a first gas retrieving channel and a second gas retrieving channel interconnected to each other with their axes perpendicular to each other; the first gas retrieving channel is connected with the pump, and the axis of the second gas retrieving channel is oriented perpendicular the surface of the substrate.

In an example, the gas blower has a gas feeding pressure greater than a gas drawing pressure of the pump.

In an example, the second gas feeding channel and the second gas retrieving channel are provided adjacent to each other.

In an example, the substrate heating apparatus further comprises a heating chamber, wherein the heating unit and the suspension holding unit are located in the heating chamber; the suspension holding unit further comprises: suction cups for gripping the substrate by suction so that the substrate is held above the heating unit in suspension; the suction cups are provided at an upper portion of the heating chamber, and the heating unit is provided at the bottom of the heating chamber.

In an example, the suction cups are distributed along the periphery of the substrate.

In an example, the suction cups are expandable and retractable with an expandable-and-retractable direction perpendicular to the surface of the substrate.

In an example, the substrate heating apparatus further comprises at least two opposing stopper units on a side inside surface of the heating chamber for controlling positioning of the substrate relative to the heating unit.

In an example, the stopper units are expandable and retractable.

The substrate heating apparatus according to the embodiment of the present disclosure comprises: a heating unit and a suspension holding unit for holding the substrate above the heating unit so that there is no physical contact between the substrate and the heating unit. In this way, it can not only avoid collision and friction on the substrate and thus decreasing the damage to the substrate, but also ensure uniform heating of the substrate as the substrate is heated by the heating unit.

BRIEF DESCRIPTION OF THE DRAWINGS

In order to clearly illustrate the technical solutions of the present disclosure or the prior art, the drawings for the description of the technical solutions according to the disclosure or the prior art will be briefly described as below. It is obvious that the described drawings are only illustrative explanations of some specific implementations of the technical solutions of the disclosure. Based on these drawings, those skilled in the art can obtain other drawing(s), without any inventive work.

DETAILED DESCRIPTION

Below, the technical solutions in the embodiments of the present disclosure will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Unless otherwise defined, technical jargon or scientific terms used herein should be interpreted in the usual sense as understood by those ordinary skilled in the relevant art of the present disclosure. The terms "first", "second", and the like, used in the specification and claims of this patent application of the disclosure, do not denote any order, quantity, or importance, but are used to distinguish among different integral parts. Likewise, the words "a" or "an" or the like, herein do not denote a limitation of quantity, but denote the presence of at least one of the referenced item. The terms "connection" or "interconnection" or the like, are not limited to physical or mechanical connections, but can comprise electrical connection, whether direct or indirect. The terms "upper", "lower", "left", "right" and the like, are only used to indicate a relative positional relationship, which can be varied with a change of an absolute position of a described object.

The substrate heating apparatus according to an embodiment of the present disclosure comprises: a heating unit and a suspension holding unit for holding the substrate above the heating unit in suspension.

Since the substrate is held above the heating unit in suspension, therefore it has no physical contact with the heating unit. This can avoid collision and friction on the substrate, thus decreasing damage to the substrate, and ensuring uniform heating of the substrate by the heating unit. For the skilled in the art to better understand and implement the present disclosure, the embodiment of the present disclosure will be described in detail as below with reference to FIGS. 3-12, by explaining the implementation of holding a glass substrate in suspension. It should be understood that, the present disclosure is also applicable to hold devices or components other than the glass substrate.

Figure 1:
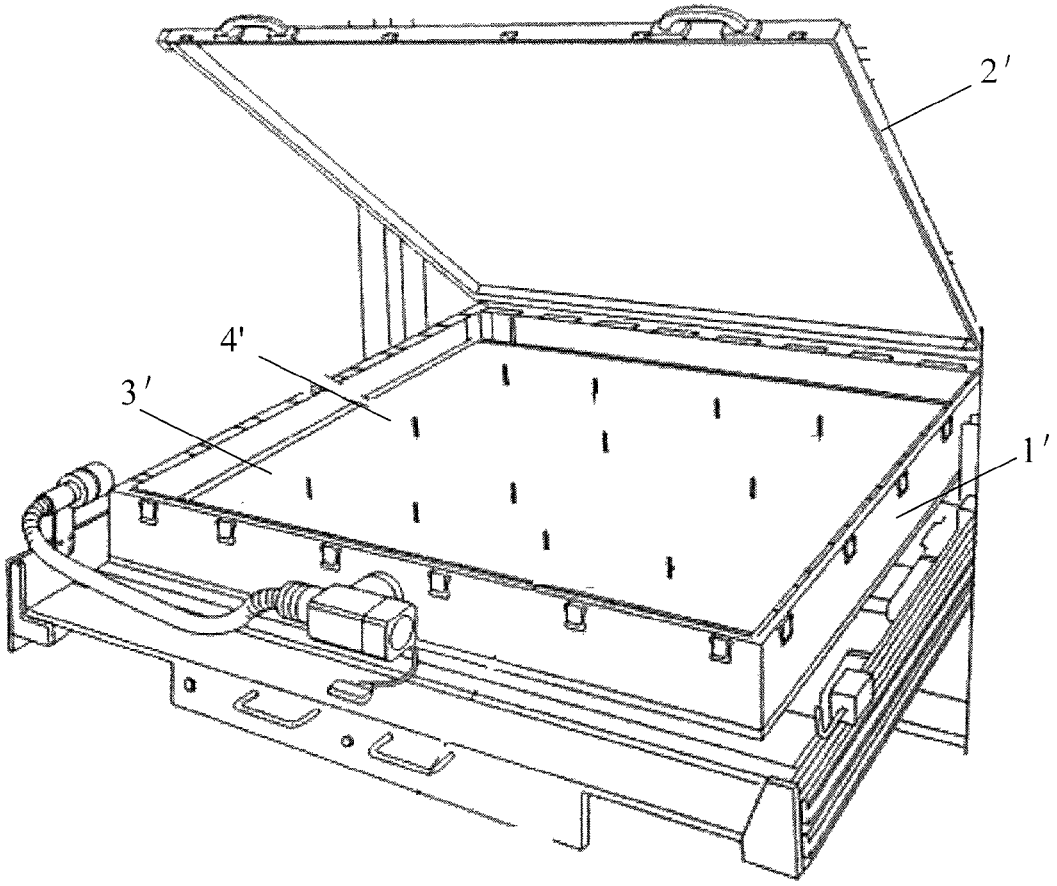
FIG. 1 is a schematic view of a conventional heating apparatus.
Figure 2:
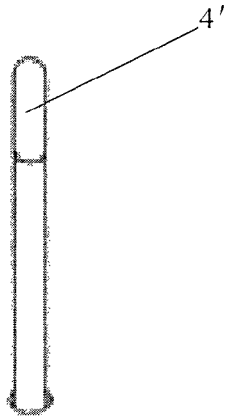
FIG. 2 is an enlarged schematic view of a supporting pin in FIG. 1.
Figure 3:
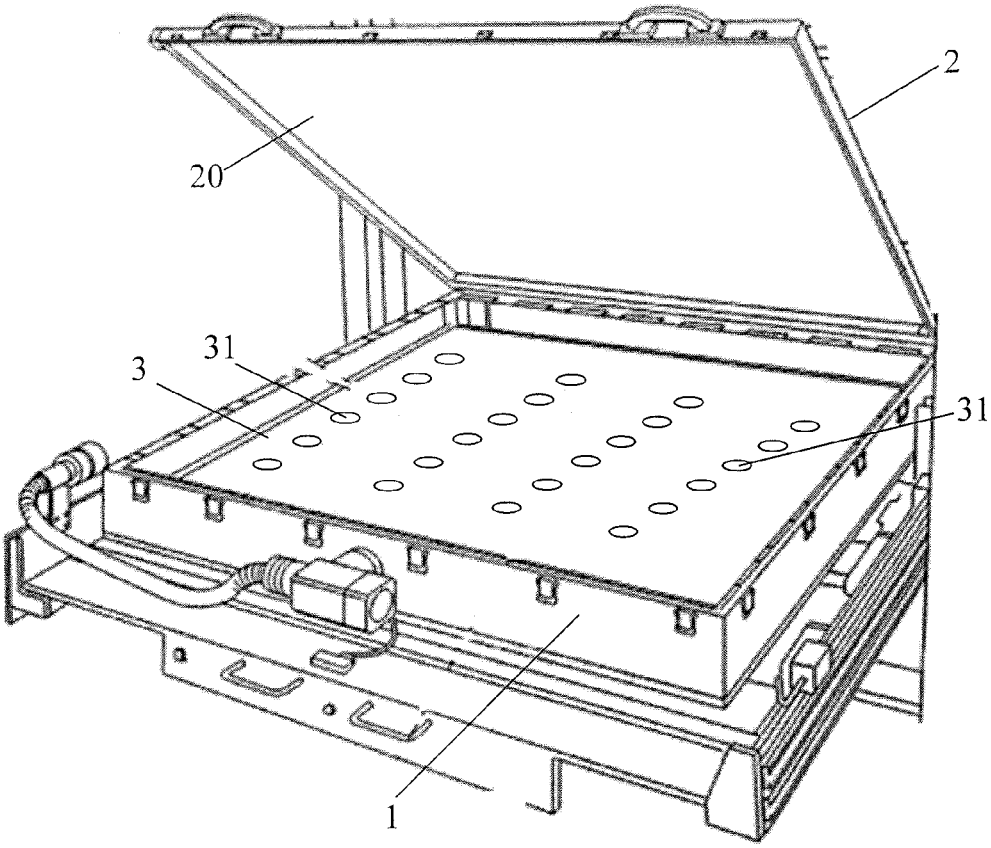
FIG. 3 is a perspective view of a substrate heating apparatus according to an embodiment of the present disclosure.

FIG. 3 is a schematic view of a substrate heating apparatus according to an embodiment of the present disclosure. As shown in FIG. 3, the heating apparatus comprises: a heating unit 3 and a suspension holding unit. The heating unit 3 and the suspension holding unit can be disposed in a heating chamber 1, and this increases heating efficiency. A glass substrate (not shown), for example, is placed in the heating chamber 1. The heating unit 3 is provided at the bottom of the heating chamber 1. The suspension holding unit can be a gas-flow supporting unit which blows gas flow toward the glass substrate so that the glass substrate is held above the heating unit 3 in suspension by means of gas-flow supporting. The force applied by the gas flow on the glass substrate is constant and equal to the gravity of the glass substrate so that the glass substrate is held in stable suspension. In specific implementations, the heating chamber in the embodiment of the present disclosure can be optionally provided or not provided depending on different needs.

The suspension holding unit in the embodiment of the present disclosure can comprise any means which can hold the substrate in suspension other than the gas-flow supporting unit, and the present disclosure is not limited in this regard.

Figure 4:
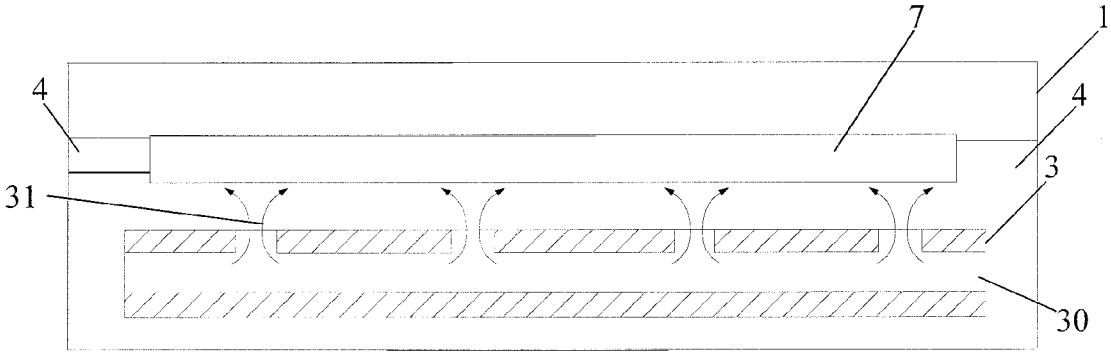
FIG. 4 is a side view of the substrate heating apparatus according to the embodiment of the present disclosure.
Figure 5:
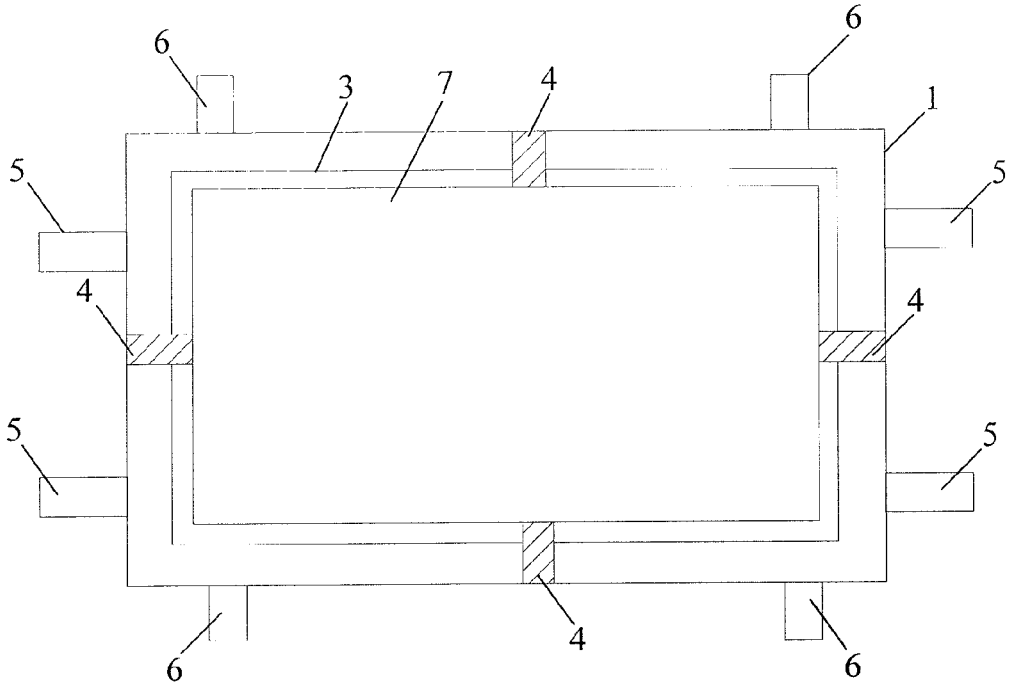
FIG. 5 is a top view of the substrate heating apparatus according to the embodiment of the present disclosure.

As shown in FIG. 4 and FIG. 5, the gas-flow supporting unit for example comprise: a gas source (not shown in the Figures), a gas blower 5 connected with the gas source, and a gas feeding channel 30 and 31 connected with the gas blower 5. The gas feeding channels 30 and 31 are provided in the heating unit 3, and the gas blower 5 blows a gas flow through the gas feeding channel 31 toward the glass substrate 7.

Figure 6:
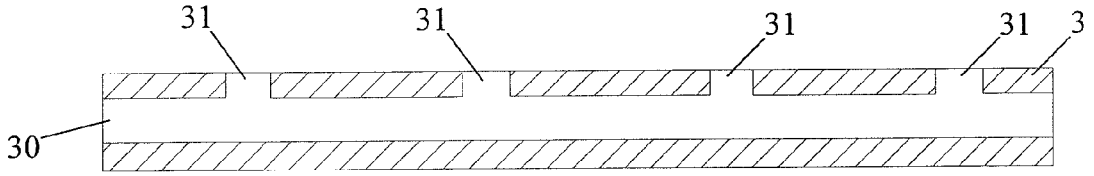
FIG. 6 is a side sectional view of a gas feeding channel according to an embodiment of the present disclosure.
Figure 7:
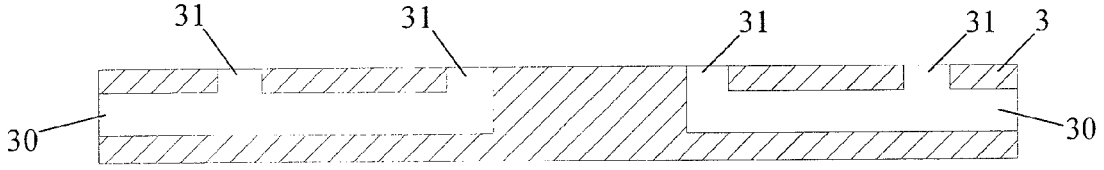
FIG. 7 is a side sectional view of another gas feeding channel according to an embodiment of the present disclosure.

With reference to FIG. 4 as well as FIG. 6 or FIG. 7, the gas feeding channel comprises a first gas feeding channel 30 and a second gas feeding channel 31, which are interconnected and their axes are perpendicular to each other. The first gas feeding channel 30 is connected with the gas blower 5, and the second gas feeding channel 31 is oriented toward the glass substrate 7. The gas flow passes firstly through the first gas feeding channel 30 and then turns and flows out of the second gas feeding channel 31. Thus, the gas flow is blew toward the glass substrate 7 in a roundabout way, and this prevents the glass substrate 7 from being damaged by a large impact force which would be otherwise introduced by a direct strike by the gas flow onto the glass substrate 7.

The first gas feeding channel 30 can be a channel running-through the heating unit 3, as shown in FIG. 6, or can be channels which do not completely run through the heating unit 3, as shown in FIG. 7. Each first gas feeding channel 30 connects with a plurality of second gas feeding channels 31. Alternatively, a plurality of first gas feeding channels 30 connect with one second gas feeding channel 31. Alternatively, the heating unit 3 has a hollow center portion which forms the first gas feeding channel 30 and a plurality of second gas feeding channels 31 connected with the hollow center portion.

Since the heating unit 3 serves to heat the glass substrate 7 to a certain temperature, as the gas blower 5 blows gas into the gas feeding channel in the heating unit 3, in order to prevent the temperature of the blew gas from affecting the temperature of the heating unit 3, the temperature of the gas and the temperature of the heating unit 3 are made to be the same or similar. To achieve this purpose, the embodiment of the present disclosure has two implementations as following.

In a first implementation, a gas heater is provided between the gas source and the gas blower 5, so that the gas passes through the heater before being blew into the gas feeding channel, and reaches to a same or similar temperature of the heating unit 3. Certainly, the gas heater is not limited to the above-described arrangement. For example, the gas heater can be provided between the gas blower 5 and the first gas feeding channel 30.

In a second implementation, a gas retrieving unit connected with the gas source is provided so that a gas flow cycling channel is formed. Since a gas flow that flows out of the gas feeding channel after being heated by the heating unit 3 has a temperature that is the same or similar as the temperature of the heating unit 3, the gas flow is retrieved by the gas retrieving unit so that the retrieved gas flow can again be blew into the gas feeding channel by the gas blower, thereby effectively utilizing the gas flow and saving resources.

For a better understanding of this, the present disclosure will be further explained in the second implementation.

In the second implementation described above, the gas retrieving unit specifically comprises: a pump 6 as shown in FIG. 5, and a gas retrieving channel connected with the pump 6. The gas retrieving channel is provided in the heating unit 3, and the pump 6 draws a gas flow through the gas retrieving channel toward the heating unit.

Figure 8:
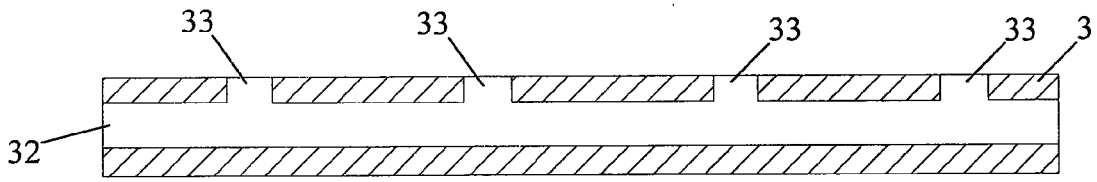
FIG. 8 is a side sectional view of a gas retrieving channel according to an embodiment of the present disclosure.
Figure 9:
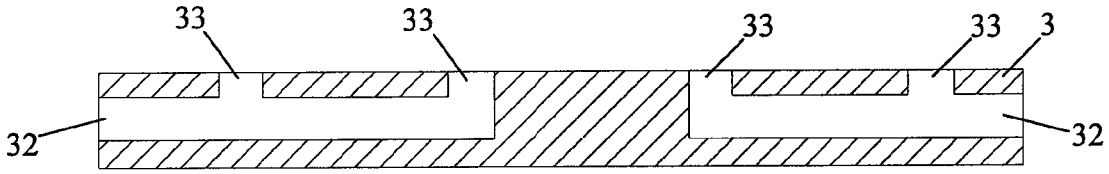
FIG. 9 is a side sectional view of another gas retrieving channel according to an embodiment of the present disclosure.

As shown in FIG. 8 or FIG. 9, the gas retrieving channel specifically can also comprises a first gas retrieving channel 32 and a second gas retrieving channel 33 interconnected with each other and their axes are perpendicular to each other. The first gas retrieving channel 32 is connected with the pump 6, and the second gas retrieving channel 33 is oriented toward the substrate 7 so that the pump 6 draws a gas flow from the second gas retrieving channel 33 and the first gas retrieving channel 32 sequentially into the gas source, then is blew into the gas feeding channel again by the gas blower 5, thus forming a gas cycling flow channel.

The first gas retrieving channel 32 can be a channel running through the heating unit 3 as shown in FIG. 8, or can be channels which do not run completely through the heating unit 3 as shown in FIG. 9. Moreover, each first gas retrieving channel 32 connects with a plurality of second gas retrieving channels 33. Alternatively, a plurality of first gas retrieving channels 32 connect with one second gas feeding channel 31.

In case that there is only a gas flow blew into the heating chamber 1, the glass substrate 7 might float up and down in the gas flow, thus affecting the heating effect. In order to avoid such phenomenon, the gas retrieving unit as described above can also keep the suspended glass substrate 7 always in a stable state during a heating process in addition to the function of retrieving the gas flow.

In order to ensure that the glass substrate 7 is always suspended above the heating unit 3, the gas feeding pressure of the gas blower 5 is greater than the pumping pressure of the pump 6. The gas blower 5 and the pump 6 can be integrated into a single device, thus reducing the number of components of the substrate heating apparatus.

The second gas feeding channel 31 (also can be referred as a positive-pressure hole) and the second gas retrieving channel 33 (also can be called as a negative-pressure hole) are provided adjacent to each other. This can ensure the gas pressure in all second gas feeding channels 31 and regions in vicinity consistent, and it in turn can ensure that the glass substrate 7 is stably suspended above the heating unit 3, thereby avoiding tilting of the glass substrate 7 and resultant non-uniform heating.

Figure 10:
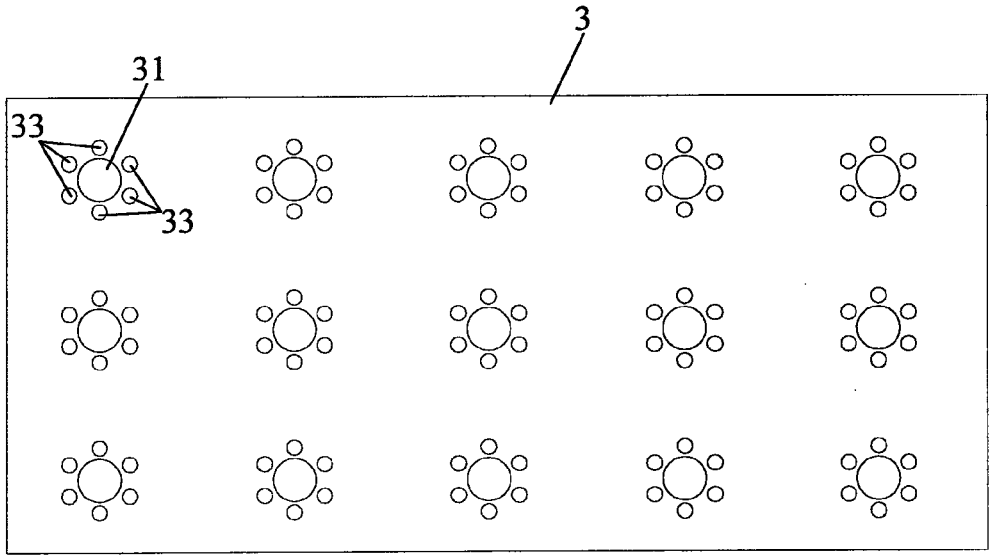
FIG. 10 is a top view of a first heating unit according to an embodiment of the present disclosure.
Figure 11:
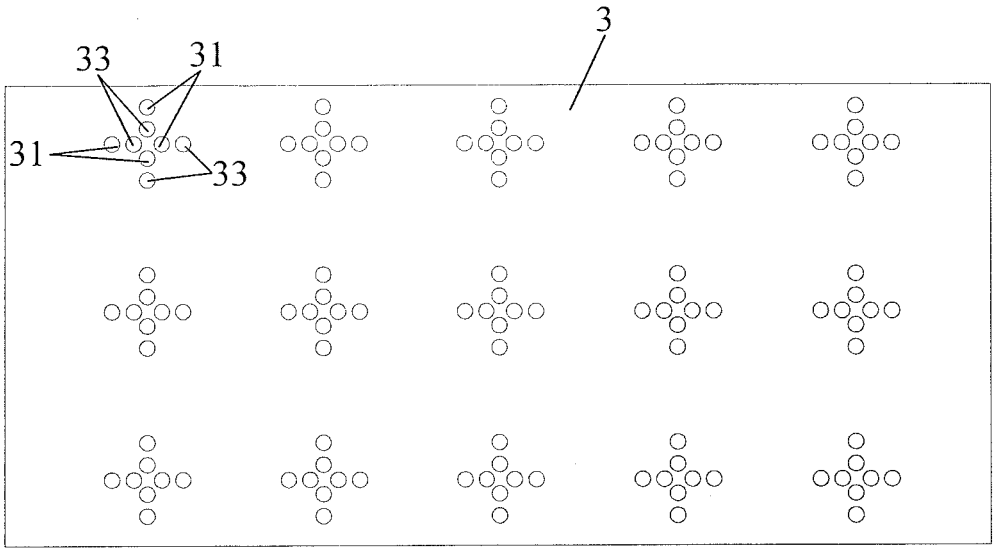
FIG. 11 is a top view of a second heating unit according to an embodiment of the present disclosure.
Figure 12:
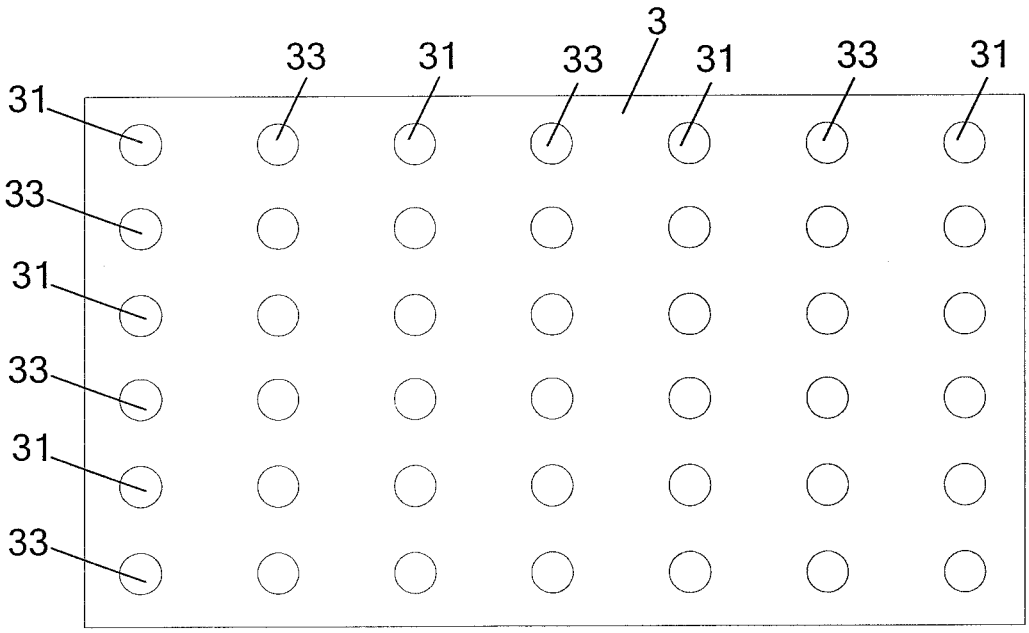
FIG. 12 is a top view of a third type heating unit according to an embodiment of the present disclosure.

The configuration that the second gas feeding channel 31 and the second gas retrieving channel 33 are provided adjacent to each other can be in an arrangement as shown in FIG. 10, in which the second gas retrieving channels 33 are provided circumferentially around the second gas feeding channel 31. Alternatively, the configuration can be in an arrangement as shown in FIG. 11 in which the second gas feeding channel 31 and the second gas retrieving channel 33 are provided in a cross shape, and the second gas feeding channel 31 and the second gas retrieving channel 33 are disposed alternately along transverse and longitudinal directions of the cross. Alternatively, the configuration can be in an arrangement as shown in FIG. 12 in which the second gas feeding channel 31 and the second gas retrieving channel 33 are disposed alternately along the vertical and horizontal directions. Alternatively, the configuration can be in an arrangement that combines any two or three of the above-mentioned arrangements. In addition, the second gas feeding channel 31 and the second gas retrieving channel 33 can have a cross sectional shape of a rectangular, a T-shape or funnel-shape. Certainly, the above-described arrangements and hole shapes are only examples, and the embodiment of the present disclosure is not limited thereto.

As shown in FIG. 3, the suspension holding unit in the embodiment of the present disclosure also can comprise suction cups (not shown) for sucking the glass substrate provided at an upper portion of the heating chamber, for example, on an inner surface of the cover 2 of the substrate heating apparatus, i.e., the inner top surface 20 of the heating chamber 1. After the glass substrate is conveyed into the heating chamber 1, the gas-flow supporting unit holds the glass substrate above the heating unit 3 in suspension, and the suction cups grip the glass substrate by suction so that, the glass substrate can be held above the heating unit in suspension 3 more stably, which further ensures the heating effect.

In addition, as the glass substrate is suspended by the cooperative actions of the gas-flow supporting unit and the suction cups, since the suction cups apply a suction force onto the glass substrate along a direction opposite to the gravity of the substrate, the supporting force given by the gas flow to the glass substrate is supplemented. Therefore, this can reduce simultaneously the gas feeding pressure of the gas blower 5 and the pumping pressure of the pump 6 as shown in FIG. 5, thereby reducing the power consumption of the gas blower 5 and the pump 6.

Because the surface flatness of the glass substrate has a considerable influence on the liquid crystal display panel, in order to avoid affecting the display quality of the liquid crystal panel, a plurality of suction cups are distributed along the periphery of the glass substrate, thus ensuring that the suction cups do not contact the display region of the glass substrate 7.

The above-described suction cups are expandable, and their expansion and retraction direction is perpendicular to the surface of the glass substrate 7. Thus when the glass substrate 7 is conveyed into the heating chamber 1, the suction cups can be in a retracted state to avoid a collision between the glass substrate 7 and the suction cups. And after the glass substrate 7 is centered with respect to the heating unit 3, the suction cups can expand and grip the glass substrate.

Again with reference to FIG. 4 or FIG. 5, in the embodiment of the present disclosure, at least two opposing stopper units 4 for controlling the position of the substrate 7 relative to the heating unit 3 can be provided on side surfaces inside the heating chamber 1. After the glass substrate 7 is conveyed into the heating chamber 1, the glass substrate 7 and the heating unit 3 can be placed exactly opposite to each other using the stopper units 4, which can improve the heating effect.

The stopper units 4 can be expandable and retractable. Since the glass substrate 7 has various types and thus they have different dimensions, the expandable-and-retractable stopper units 4 can accommodate the glass substrates 7 with different dimensions within the same heating apparatus.

Although not shown, in order to facilitate conveying the glass substrate 7, a side surface of the heating chamber 1 is a movable wall that can be opened; thus after the movable wall is opened, a robotic arm can convey the glass substrate 7 from the opening into the heating chamber 1, and then close the movable wall.

The heating unit 3 can be made of a material with a high thermal conductivity so as to ensure temperature uniformity during heating. Although not shown, the above-described expandable-and-retractable stopper units 4, the expandable-and-retractable suction cups, as well as the movable wall can be implemented by a pneumatic or electric-controlled means.

The above embodiments are only intended to be illustrative but not to limit the present disclosure. A variety of modifications and variations can be made by the ordinary skilled in the related art, without departing from the spirit and the scope of the present disclosure; thus, all equivalent technical solutions should be within the scope of the present disclosure, and the scope of the present disclosure should be defined by the claims.

What is claimed is:

1. A substrate heating apparatus, comprising:

a heating unit, and a suspension holding unit located on the heating unit and hold the substrate above the heating unit in suspension, wherein the suspension holding unit comprises: a gas-flow supporting unit for blowing a gas toward the substrate, the gas-flow supporting unit comprises a gas feeding unit and a gas retrieving unit which are both provided in the heating unit, the gas feeding unit comprises: multiple first gas feeding channels and multiple second gas feeding channels interconnected to each other with their axes perpendicular to each other; and the gas retrieving unit comprises multiple first gas retrieving channels and multiple second gas retrieving channels interconnected to each other with their axes perpendicular to each other, wherein the second gas feeding channels and the second gas retrieving channels are formed as holes and provided adjacent to each other in such a manner that the second gas feeding channels are arranged in line direction and column direction at an array and the second gas retrieving channels are provided circumferentially around each of the second gas feeding channels.

2. The substrate heating apparatus according to claim 1, wherein the gas-flow supporting unit further comprises: a gas source, and a gas blower connected with the gas source, wherein the gas feeding unit is connected with the gas blower, and the gas blower blows a gas flow through the gas feeding unit, and the gas flow blew from the gas feeding unit has a flowing direction toward the substrate.

3. The substrate heating apparatus according to claim 2, wherein the multiple first gas feeding channels are connected with the gas blower, and the axis of each of the multiple second gas feeding channel is oriented perpendicular to the surface of the substrate.

4. The substrate heating apparatus according to claim 3, wherein the gas-flow supporting unit further comprises: a gas heater provided between the gas source and the gas blower, the gas heater has a first side connected with the gas source and a second side connected with the gas blower.

5. The substrate heating apparatus according to claim 3, wherein the gas retrieving unit is connected with the gas source and retrieves a gas flow flowing out of the gas feeding unit.

6. The substrate heating apparatus according to claim 5, wherein the gas retrieving unit further comprises: a pump connected with the gas source:

the gas retrieving unit is connected with the pump, and the pump draws a gas flow through the gas retrieving unit toward the heating unit.

7. The substrate heating apparatus according to claim 6, wherein the multiple first gas retrieving channels are connected with the pump, and the axis of each of the second gas retrieving channels is oriented perpendicular the surface of the substrate.

8. The substrate heating apparatus according to claim 7, wherein the gas blower has a gas feeding pressure greater than a gas drawing pressure of the pump.

9. The substrate heating apparatus according to claim 1, further comprising a heating chamber, wherein the heating unit and the suspension holding unit are located in the heating chamber.

10. The substrate heating apparatus according to claim 9, further comprising at least two opposing stopper units on a side inside surface of the heating chamber for controlling positioning of the substrate relative to the heating unit.

11. The substrate heating apparatus according to claim 10, wherein the stopper units are expandable and retractable.

12. The substrate heating apparatus according to claim 9, wherein the suspension holding unit further comprises: suction cups for gripping the substrate by suction so that the substrate is held above the heating unit in suspension.

13. The substrate heating apparatus according to claim 12, wherein the suction cups are provided at an upper portion of the heating chamber, and the heating unit is provided at the bottom of the heating chamber.

14. The substrate heating apparatus according to claim 12, wherein the suction cups are distributed along the periphery of the substrate.

15. The substrate heating apparatus according to claim 12, wherein the suction cups are expandable and retractable with an expandable-and-retractable direction perpendicular to the surface of the substrate.

* * * * *